United States Patent [19]

Takenoya

[11] 4,231,307

[45] Nov. 4, 1980

[54] PULSE GENERATOR FOR SEWING MACHINES

[75] Inventor: Hideaki Takenoya, Hachioji, Japan

[73] Assignee: Janome Sewing Machine Co., Ltd., Tokyo, Japan

[21] Appl. No.: 948,321

[22] Filed: Oct. 4, 1978

[30] Foreign Application Priority Data

Oct. 4, 1977 [JP] Japan ..... 52-132858[U]

[51] Int. Cl.[2] ..... D05B 3/02

[52] U.S. Cl. ..... 112/158 E; 250/233

[58] Field of Search ..... 112/158 E, 275, 277, 112/121.11, 121.12; 250/233

[56] References Cited

U.S. PATENT DOCUMENTS

| | | | |
|---|---|---|---|
| 3,847,100 | 11/1974 | Garron | 112/158 E |
| 3,989,943 | 11/1976 | Campbell et al. | 250/233 |
| 4,103,632 | 8/1978 | Bowles | 112/158 E |

*Primary Examiner*—Peter P. Nerbun

*Attorney, Agent, or Firm*—Michael J. Striker

[57] ABSTRACT

A sewing machine comprises a machine housing, a main shaft rotatably mounted on the machine housing, a needle bar swingably mounted and vertically reciprocated by the main shaft, a feeding device operated in time relationship with the needle bar, an electric motor for controlling the lateral movement of the needle bar, another motor for controlling the movement of the feeding device, and a pulse generating unit for generating pulses controlling the operation of the first and second electric motors. The pulse generating unit comprises two rotational parts cooperating with two pulse generators which respond to the presence and absence of the rotational parts. The two rotational parts are each formed with an axial extension with a recess and a projection. A ring member receives the axial extensions of the rotational parts to connect them to each other and, when the ring member is secured to the main shaft, to connect them to the main shaft of the machine.

6 Claims, 7 Drawing Figures

PULSE GENERATOR FOR SEWING MACHINES

BRIEF DESCRIPTION OF THE INVENTION

The invention relates to a pulse generator for a sewing machine and more particularly relates to an improved pulse generator which is composed of independent pulse generating parts each adjustably mounted on the sewing machine in relation to the main shaft thereof and generating effective pulses to a drive device, for example a drive circuit which is adapted to commonly operate the actuators of the needle bar and of the fabric feeding device.

In the conventional sewing machines using pattern cams, the lateral amplitude of the needle and the fabric feeding are controlled in synchronism with the vertical movement of the needle by means of the timing belts or gears. On the other hand, in a sewing machine provided with a pattern generating device to be electrically controlled according to the invention, it is necessary to electrically synchronize the operations of the drive sources such as pulse motors with the vertical movement of the needle, the pulse motors controlling the lateral movement of the needle and the movement or the direction of the movement of the fabric feeding mechanism respectively.

The drive sources such as pulse motors are generally individually required to control the lateral movement of the needle and the movement or direction of the movement of the fabric feeding mechanism in view of the mechanism of the sewing machine.

In reference to FIG. 1 of the attached drawings, the positional or phase relation of the vertical movement of the needle and the vertical movement of the feed dog can be asymmetrically shown in the upper and the lower sides of the needle plate (C) in relation to the rotation angle $\theta$ of the main shaft of the sewing machine, though there may be a slight difference depending upon the sewing machine involved. The upper side of the needle plate (C) is a range in which the lateral movement of the needle (A) can be controlled, and the lower side of the needle plate (C) is a range in which the movement of the feed dog (B) can be controlled. As to the drive of the drive sources such as pulse motors, substantially one must be driven while the other is at rest and vice versa. Therefore it is preferable to provide one shared drive device or drive circuit to alteranely drive the drive sources.

As described, the invention relates to a pulse generator generating the effective pulses for the drive device or drive circuit which is common to the two drive sources such as the pulse motors for individually controlling the lateral movement of the needle and the movement or the direction of the movement of the feed dog respectively. In order to operate the drive circuit for the purpose of exactly discriminating and driving the two drive sources or pulse motors, the pulse generator of the invention is designed to provide, as shown in FIG. 1, a range (A') of about 180° for driving the pulse motor controlling the lateral movement of the needle and a range (B') of about 130° for driving the pulse motor controlling the movement or the direction of movement of the feed dog. The pulse generator is also designed to provide rest ranges ($\alpha_1$, $\alpha_2$) between the two driving ranges. Further according to the invention the pulse generator is designed towards adjustably shift the two driving ranges to each other on the condition that one of the rest ranges will not be eliminated or removed. Namely the pulse motor driving ranges may be shifted towards each other without changing the total of the rest ranges. In the driving ranges (A', B'), there are provided the initial points (a, b) to be detected, at which the pulse motors are each driven by the pulses generated thereat. These pulse motors are each driven by the pulses generated thereat. These pulse motors are stopped at the respective ends of the driving ranges (A', B').

In reference to FIG. 2 simply showing the pulse generator of the invention in relation to FIG. 1, the pulse generator comprises a detecting point D including pulse generating parts (4, 4*a*), the range (A') which is actually a detected screening plate 5 for driving the pulse motor for controlling the lateral movement of the needle and rotated with the main shaft of the sewing machine in the direction as shown by the arrow mark, the range (B') which is actually a detected screening plate (6) for driving the pulse motor for controlling the movement or the direction of movement of the feed dog, and the rest ranges ($\alpha_1$, $\alpha_2$) between the two detected screening plates (5, 6). These two detected screening plates are angularly adjustable to each other.

In case one of the rest ranges ($\alpha_1$, $\alpha_2$) is eliminated or removed to adjacently connect the detected screening plates (5, 6), the detected screening ranges (A', B') may be coded with the logic values 1, 1 respectively and the non-detected range may be coded with 0, 0. In this case the four kinds of combinations of the logic values 0, 10, 01, 11 appear at the pulse generating parts (4, 4) during one complete rotation of the pulse generator. If the code 10 or 01 is used to selectively drive one of the pulse motors and the code 00 is used to rest both pulse motors, it becomes necessary to determine whether the code 11 is used to rest both pulse motors or is used to precede the drive of one of the motors to the other. Namely it is the object of the invention to include no code such as the code 11 in the adjustable range of the detected screening plates (5, 6).

The other features and advantages of the invention will be apparent from the following description in reference to the attached drawings.

DETAILED DESCRIPTION OF THE INVENTION

Figure 3:
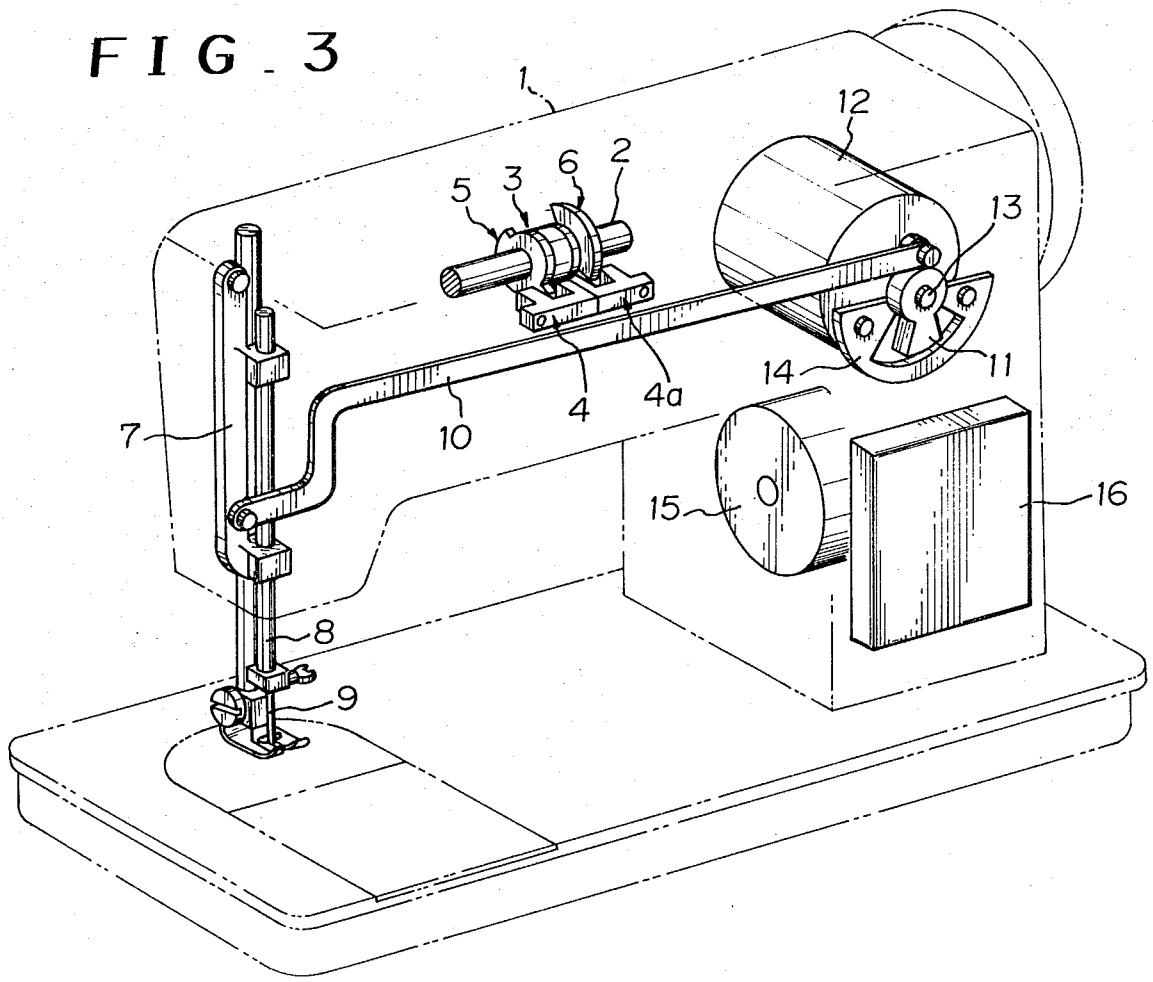
FIG. 3 shows an actual embodiment of the pulse generator of the invention mounted on the main shaft of the sewing machine, together with relevant parts of the machine.

In reference to FIG. 3, the reference numeral 1 denotes a sewing machine housing. The numeral 2 denotes a main shaft though it is only partly illustrated, which is rotatably supported in the machine housing. The numeral 3 is a pulse generator mounted on the main shaft for rotation therewith. The pulse generator is composed substantially of two semi-circular screening plates 5, 6 on the main shaft 2 and pulse generating parts 4, 4*a* fixedly mounted on the machine housing adjacent to the semi-circular screening plates. The plates 5 and 6 are angularly adjustable relative to each other in relation to the pulse generating parts 4, 4*a* so that the pulse generation time may be varied at will. The reference numeral 7 denotes a laterally swingable needle bar support supporting a needle bar 8 with a needle 9 for vertical reciprocating movement. The reference numeral 10 is a transmission rod connected at one end to the needle bar support 7 and connected at the other end to a link 11 which is fixedly secured to the rotational output shaft 13 of a pulse motor 12. Therefore the pulse motor 12 is driven to laterally reciprocate the transmission rod 10, thereby to laterally swing the needle bar support 7. The reference numeral 14 denotes a stopper secured to the pulse motor 12 for limiting the movement of the output shaft 13 by way of the link 11. The reference numeral 15 is another pulse motor for controlling the movement of the feeding mechanism (not shown). The transmission device between the pulse motor 15 and the feeding mechanism is not shown because it is substantially the same as that between the pulse motor 12 and the needle bar support 7. The reference numeral 16 denotes a control device or circuit for controlling the pattern data and the drive of the pulse motors 12, 15. The control device receives the pulses generated from the pulse generating parts 4, 4*a* of the pulse generator 3.

Figure 2:
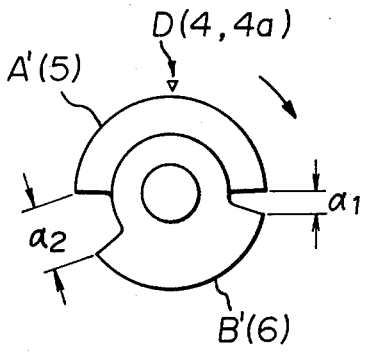
FIG. 2 shows a diagramatical representation of the pulse generator of the invention in relation to FIG. 1.
Figure 4:
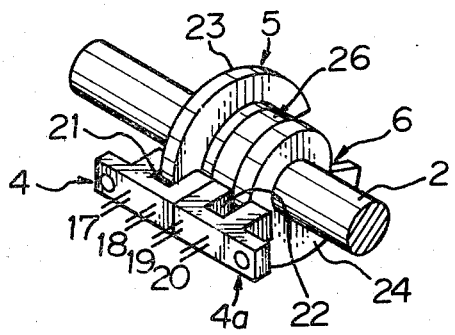
FIG. 4 shows a perspective view of th pulse generator of the invention mounted on the main shaft of the sewing machine.

In reference to FIGS. 2 and 4, the semi-circular screening plates 5, 6 are mounted on the main shaft with an angular difference of about 180° therebetween. The pulse generating part is composed substantially of two forks 4, 4*a* with grooves 21, 22 as shown each provided with a phototransistor and a light emitting diode in a spaced relation, though they are not illustrated. Those phototransistors and the light emitting diodes are each connected to the control device 16 by means of the leads 17–20. While the parts 23, 24 of a larger diameter of the respective semi-circular screening plates 5, 6 are positioned in the corresponding grooves 21, 22, the light is interrupted to the phototransistors from the light emitting diodes respectively, and the pulses of the corresponding width are generated.

Figure 1:
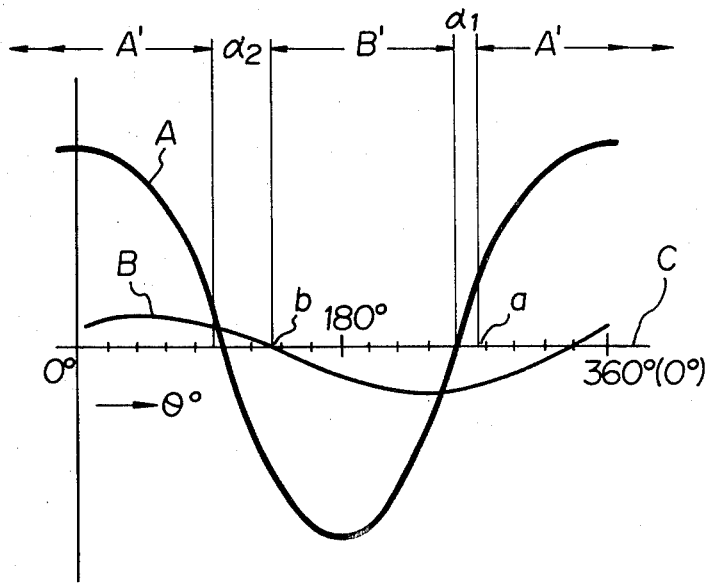
FIG. 1 shows the relative positional or phase relation of the needle point and the feed dog in relation to the needle plate and the rotation of the main shaft of the sewing machine.
Figure 5:
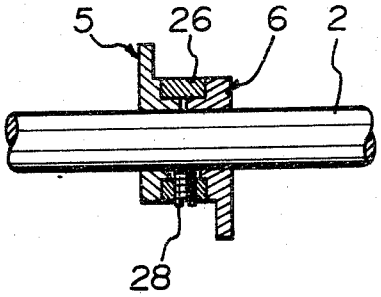
FIG. 5 shows in the vertical section the parts of the pulse generator of the invention adjustably assembled on the main shaft of the sewing machine, FIG 6-A shows an exploded view of the pulse generator of the invention, and FIG. 6-B shows a particular part of the pulse generator of the invention seen from the side of the arrow mark of FIG. 6-A.
Figure 5:
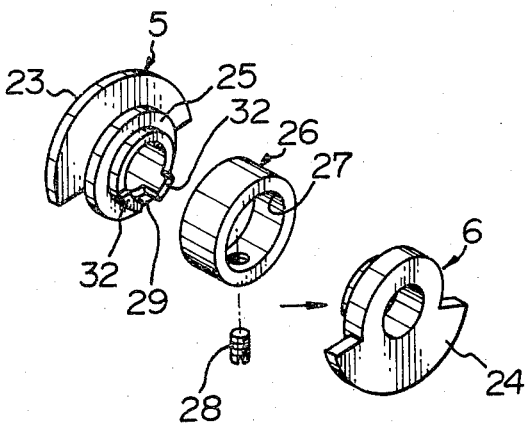
Figure 5:
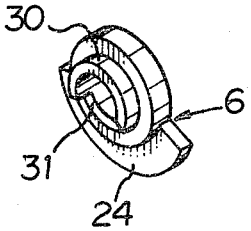

In reference to FIGS. 4–6, the screening plate 5, a ring 26 and the screening plate 6 are inserted on the main shaft 2 in that order. As shown the screening plate 5 is provided on one side thereof with a flange 25 and a central collar of a smaller diameter formed with a pair of projections 32, 32 with a space 29 therebetween. On the other hand, the screening plate 6 is provided on one side thereof with a central collar 30 formed with a cutout 31. Firstly the central collar with the projections 32, 32 of the screening plate 5 is inserted into the ring 26 having the inner surface 27, and provisionally secured to the main shaft by means of a fastening screw 28 passing through the threaded bore of the ring 26 and through the space 29 between the projections 32, 32 of the screening plate 5 and to the main shaft. Secondly the collar 30 of the screening plate 6 is inserted into the ring 26 on the opposite side thereof in such a manner that the spaced projections 32, 32 of the screening plate 5 are received in the cutout 31 of the collar 30. Thus the screening plate 6 is angularly adjustable with respect to the screening plate 5 to provide the angular ranges $\alpha_1$, $\alpha_2$ as shown in FIG. 2. Then the fastening screw 28 is further fastened to fixedly secure the three members 5, 26, 6 to the main shaft 2 as shown in FIG. 5. In this embodiment, the screening part 23 of the screening plate 5 has an angular extension of about 180° for setting the driving range A', as shown in FIG. 1, of the pulse motor 13 for controlling the lateral movement of the needle bar. On the other hand, the screening part 24 of the screening plate 6 has an angular extension of about 130° for setting the driving range B', as shown in FIG. 1, of the pulse motor 15 for controlling the movement of the feed dog (not shown). Thus the pulse generator of the invention provides a large rotational angle of the main shaft in which the control of the lateral movement of the needle is exactly effected. Namely as long as the needle point A is positioned above the needle plate C, the lateral movement of the needle can be exactly controlled for the initial needle position of a selected pattern, or even if a modification of the pattern is made by the operator during the stitching operation. Namely the pulse generator is designed not to be so much restricted by the vertical needle positions in controlling the lateral movement of the needle.

Now in reference to FIGS. 1–4, immediately after the needle point A comes to have the needle plate C during the vertical reciprocation thereof, the screening part 23 of the screening plate 5 interrupts at the position (a) the light to the phototransistor from the light emitting diode at the pulse generating part 4, and when the needle point A comes close to the needle plate C after passing through the upper dead point thereof, the screening part 23 ceases the interruption of light. In the meantime, the pulse generating part 4 continues to generate pulses to the control device 16, and the pulse motor 12 is driven by the pattern data from the control device 16, thereby to control the lateral movement of the needle with an adjusting time remarkably faster than the pattern data generation period.

Further as the needle point A comes to under the needle plate C and the feed dog B comes close to the upper face of the needle plate, the screening part 24 of the screening plate 6 interrupts at the position (b) the light to the phototransistor from the light emitting diode at the pulse generating part 4*a*, and the screening part 24 ceases the interruption of light at the point before the position (a) with an ample time range $\alpha_1$. In the meantime, the pulse motor 15 is driven by the pattern data from the control device 16 to control the movement of the feed mechanism. For this purpose the screening plate can be properly adjusted with respect to the main shaft 2 by optically following the movement of the needle point A, and in the same manner the screening plate 6 can be properly adjusted in relation to the movement of the feed dog B.

As the foregoing, the pulse generator of the invention is composed substantially of two parts independently generating pulses to control the pulse motors for controlling the lateral movement of the needle bar and the movement of the feeding mechanism respectively. The parts of the pulse generator are also independently adjustable in relation to the angular positions of the main shaft, so as to effectively control the pulse motors which are operated in association therewith. The pulse generator is simple in structure and easy to assemble, and is very effective practically as well as industrially.

I claim:

1. In a sewing machine which comprises a machine housing, a main shaft rotatably mounted on the machine housing, a needle bar swingably mounted and vertically reciprocated by the main shaft, a feeding device operated in timed relation with the needle bar, first electrically operated means for controlling the lateral movement of the needle bar, and second electrically operated means for controlling the movement of the feeding device, a pulse-generating system operative for generating in synchronism with rotation of the main shaft pulses controlling the operation of the first and second electrically operated means, the pulse-generating system comprising two rotational parts, two pulse-generating devices, each pulse-generating device sensing the presence and absence of a respective one of the two rotational parts and generating pulses in correspondence thereto, each rotational part having an axial extension, and furthermore including a mounting ring encircling the main shaft and receiving the axial extensions of the two rotational parts and means securing the mounting ring and thereby the two rotational parts to the main shaft.

2. In a sewing machine as defined in claim 1, the securing means comprising a set screw which presses the mounting ring and the axial extensions of the two rotational parts against the main shaft.

3. In a sewing machine as defined in claim 2, wherein the axial extension of one rotational part has a projection and the axial extension of the other rotational part has a recess which receives said projection, said recess and said projection having respective angular spans such that each rotational part is angularly adjustable relative to the other but within only a limited range of relative angular positions.

4. In a sewing machine as defined in claim 1, wherein the axial extension of one rotational part has a projection and the axial extension of the other rotational part has a recess which receives said projection, said recess and said projection having respective angular spans such that each rotational part is angularly adjustable relative to the other but within only a limited range of relative angular positions.

5. In a sewing machine as defined in claim 4, one rotational part having a sector-like angular extension of about 180° angular span, the other rotational part having a sector-like angular extension of about 130° angular span, said limited range of relative angular positions being such that the angular spans of the two sector-like angular extensions cannot overlap each other.

6. In a sewing machine as defined in claim 4, each of the two rotational parts having a respective sector-like angular extension of a respective angular span, said limited range of relative angular positions being such that the angular spans of the two sector-like angular extensions cannot overlap each other.

* * * * *